United States Patent [19]

Kubozuka

[11] Patent Number: 4,622,925

[45] Date of Patent: Nov. 18, 1986

[54] COOLING SYSTEM FOR AUTOMOTIVE ENGINE OR THE LIKE

[75] Inventor: Takao Kubozuka, Yokosuka, Japan

[73] Assignee: Nissan Motor Co., Ltd., Yokohama, Japan

[21] Appl. No.: 762,394

[22] Filed: Aug. 5, 1985

[30] Foreign Application Priority Data

Aug. 7, 1984 [JP] Japan ..... 59-164213

[51] Int. Cl.[4] ..... F01P 3/22

[52] U.S. Cl. ..... 123/41.25; 123/41.27

[58] Field of Search ..... 123/41.2–41.27

[56] References Cited

U.S. PATENT DOCUMENTS

| | | | |
|---|---|---|---|
| 1,812,899 | 7/1931 | Pope, Jr. | 123/41.26 |
| 2,389,789 | 11/1945 | Latham, Jr. | 123/41.27 |
| 2,443,518 | 6/1948 | Rushmore | 123/41.23 |
| 2,766,740 | 10/1956 | Tacchella | 123/41.25 |
| 2,804,860 | 9/1957 | Tacchella et al. | 123/41.21 |
| 3,223,075 | 12/1965 | Barlow | 123/41.24 |
| 3,312,204 | 4/1967 | Barlow | 123/41.25 |
| 4,367,699 | 1/1983 | Evans | 123/41.49 |

*Primary Examiner*—William A. Cuchlinski, Jr.

*Attorney, Agent, or Firm*—Schwartz, Jeffery, Schwaab, Mack, Blumenthal & Evans

[57] ABSTRACT

In order to minimize the size of an evaporation cooled internal combustion engine, the coolant vapor collection space located within the coolant jacket above the most strongly heated structure of the engine is reduced in size and a separator unit, which separates liquid coolant from the gaseous form, is disposed between a vapor manifold mounted on the engine a radiator in which the coolant vapor is condensed to its liquid state. The coolant collected in the separator is pumped back into the coolant jacket at locations where the coolant boils most vigorously. An amount of coolant extracted from a relatively cool section of the coolant jacket is also recirculated by the pump to the same locations.

12 Claims, 10 Drawing Figures

COOLING SYSTEM FOR AUTOMOTIVE ENGINE OR THE LIKE

BACKGROUND OF THE INVENTION

1. Field of the Invention

The present invention relates generally to a cooling system for an internal combustion engine wherein a liquid coolant is permitted to boil and the vapor used as a vehicle for removing heat from the engine, and more specifically to such a system which is compact and prevents relatively large amounts of engine coolant which "boil over" particularly at high engine load/-speed operation from reaching the condensor or radiator of the system in a manner which wets the interior of thereof to the point of reducing the efficiency with which the latent heat of evaporation of the coolant vapor can be released to the surrounding ambient atmosphere.

2. Description of the Prior Art

In currently used "water cooled" internal combustion engine such as shown in FIG. 1 of the drawings, the engine coolant (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the necessary amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kgm of water may effectively remove from the engine under such conditions is 4 Kcal. Accordingly, in the case of an engine having 1800 cc displacement (by way of example) is operated full throttle, the cooling system is required to remove approximately 4000 Kcal/h. In order to achieve this, a flow rate of 167 liter/min (viz., $4000-60\times\frac{1}{4}$) must be produced by the water pump. This of course undesirably consumes a number of otherwise useful horsepower.

FIG. 2 shows an arrangement disclosed in Japanese Patent Application Second Provisional Publication Sho. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement has suffered from the drawbacks that the radiator, depending on its position with respect to the engine proper, tends to be at least partially filled with liquid coolant. This greatly reduces the surface area via which the gaseous coolant (for example steam) can effectively release its latent heat for vaporization and accordingly condense, and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer. The undissolved air also tends to collect in the upper section of the radiator and inhibit the convention-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. Accordingly, air, due to this inherent tendency to rise, forms pockets of air which cause a kind of "embolism" in the radiator and badly impair the heat exchange ability thereof.

U.S. Pat. No. 4,367,699 issued on Jan. 11, 1983 in the name of Evans (see FIG. 3 of the drawings) discloses an engine system wherein the cooling is boiled and the vapor used to remove heat from the engine. This arrangement features a separation tank 6 wherein gaseous and liquid coolant are initially separated. The liquid coolant is fed back to the cylinder block 7 under the influence of gravity while the "dry" gaseous coolant (steam for example) is condensed in a fan cooled radiator 8. The temperature of the radiator is controlled by selective energizations of the fan 9 to maintain a rate of condensation therein sufficient to maintain a liquid seal at the bottom of the device. Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffer from rapid loss of coolant when operated at relatively high altitudes. Further, once the engine cools air is relatively freely admitted back into the system.

The provision of the separation tank 6 also renders engine layout difficult in that such a tank must be placed at relatively high position with respect to the engine, and contain a relatively large amount of coolant so as to buffer the fluctuations in coolant consumption in the coolant jacket. That is to say, as the pump 11 which lifts the coolant from the small reservoir arrangement located below the radiator, is constantly energized (apparently to obivate the need for level sensors and the like arrangement which could control the amount of coolant returned to the coolant jacket) the amount of coolant stored in the separation tank must be sufficient as to allow for sudden variations in the amount of coolant consumed in the coolant jacket due to sudden changes in the amount of fuel combusted in the combustion chambers of the engine.

Japanese Patent Application First Provisional Publication No. sho. 56-32026 (see FIG. 4 of the drawings) disclosed an arrangement wherein the structure defining the cylinder head and cylinder liners are covered in a porous layer of ceramic material 12 and coolant sprayed into the cylinder block from shower-like arrangement 13 located above the cylinder heads 14. The interior of the coolant jacket defined within the engine proper is essentially filled with only gaseous coolant during engine operation during which liquid coolant is sprayed onto the ceramic layers 12. However, this arrangement has proven totally unsatisfactory in that upon boiling of the liquid coolant absorbed into the ceramic layers, the vapor thus produced and which escapes into the coolant jacket inhibits the penetration of fresh liquid coolant and induces the situation wherein rapid overheat and thermal damage of the ceramic layers 12 and/or engine soon results. Further, this arrangement is plagued with air contamination and blockages in the radiator similar to the compressor equipped arrangement discussed above.

FIG. 7 shows an arrangement which is disclosed in copending U.S. patent application Ser. No. 663,911 filed on Oct. 23, 1984 in the name of Hirano now U.S. Pat. No. 4,549,505. The disclosure of this application is hereby incorporated by reference thereto.

This arrangement while overcoming the problems inherent in the above discussed prior art has itself suffered from the drawbacks that as most of the coolant which is contained in the system under normal operating conditions is in the coolant jacket of the cooling circuit involved with the actual removal of heat from the engine, the engine due to the provision of the coolant jacket thereabout tends to be relatively bulky especially due to the need to provide a relatively large space within the coolant jacket above the cylinder head and the like highly heated engine structure for collecting the coolant vapor produced by the boiling of the liquid coolant and allowing the boiling forth and the actual coolant vapor to separate to the degree that essentially only coolant vapor flows from the coolant jacket to the radiator for condensation. Viz., if the dimensions of the coolant jacket, especially those of the cavities formed in the cylinder head in which the coolant vapor is collected are reduced in a manner similar to that possible with conventional forced circulation type arrangements, upon the coolant boiling with any particular activity, large amounts of boiling liquid coolant are apt to the discharged from the coolant jacket in manner similar to a pot on the stove "boiling over" and induce the situation wherein the interior of the radiator or condenser is wetted and the heat exchange capacity thereof drastically reduced.

In order to obivate this problem it is possible to add a separation tank of the nature disclosed in the above discussed U.S. Pat. No. 4,367,699. However, provision of same is very difficult in that it consumes a large amount of space which is simply not available in the extremely cramped engine compartments of modern automotive vehicles and if provided, due to the need to arrange same at a relatively high location on the engine (so as to enable the gravity feed effect utilized in connection therewith), it severely hampers even simple service operations such as spark plug replacement.

For convenience, the same numerals as used in the above mentioned patent application are also used in FIG. 7.

SUMMARY OF THE INVENTION

It is an object of the present invention to provide an evaporative type cooling system which features a highly compact coolant jacket and manifold arrangement which prevents liquid coolant from entering the radiator in which gaseous coolant is condensed to its liquid state and drastically reducing the heat exchange efficiency thereof.

In brief, the above object is achieved by an arrangement wherein in order to minimize the size of an evaporation cooled internal combustion engine, the volume of the coolant vapor collection space located within the coolant jacket above the most strongly heated structure of the engine is reduced and a separator unit, which separates liquid coolant from the gaseous form, is disposed between a vapor manifold mounted on the engine a radiator in which the coolant vapor is condensed to its liquid state. The coolant collected in the separator is pumped back into the coolant jacket at locations where the coolant boils most vigorously. An amount of coolant extracted from a relatively cool section of the coolant jacket is also recirculated by the pump to the same locations.

More specifically, the present invention takes the form of an internal combustion engine having a structure subject to high heat flux, and a cooling system for removing heat from the structure, the cooling system comprising: (a) a cooling circuit including: a coolant jacket formed about the structure and into which coolant is introduced in liquid form and permitted to boil; a radiator in which gaseous coolant is condensed to its liquid state; a vapor manifold communicating with the coolant jacket; a vapor transfer conduit leading from the vapor manifold to the radiator; separation means disposed in the vapor transfer conduit for separating liquid and gaseous coolant, the separation means including a drain port; a first conduit interconnecting the drain port and the coolant jacket; a drain pump disposed in the first conduit for inducting coolant from the drain port and for pumping same into the coolant jacket; a second conduit leading from the coolant jacket to the first conduit at a location intermediate of the drain port and the pump; and coolant return means for returning liquid coolant from the radiator to the coolant jacket in a manner to maintain the structure immersed in a predetermined depth of liquid coolant.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the embodiments of the present invention, it is deemed appropriate to discuss the concept on which the present invention is based.

Figure 1:
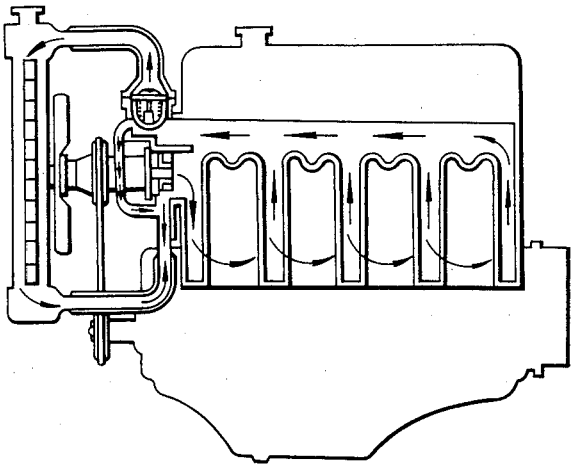
FIG.1 (PRIOR ART)
FIG. 1 is a partially sectioned elevation showing the currently used conventional water circulation type system discussed in the opening paragraphs of the instant disclosure.
Figure 2:
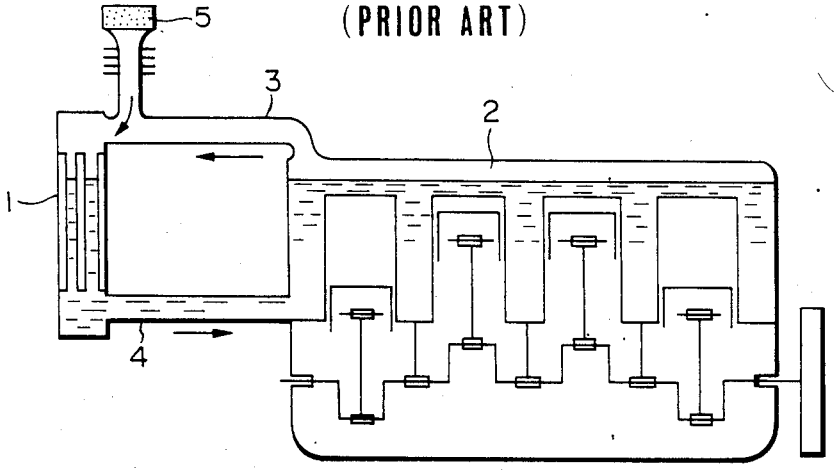
FIG.2 (PRIOR ART)
FIG. 2 is a schematic side sectional elevation of a prior art arrangement also discussed briefly in the earlier part of the specification.
Figure 3:
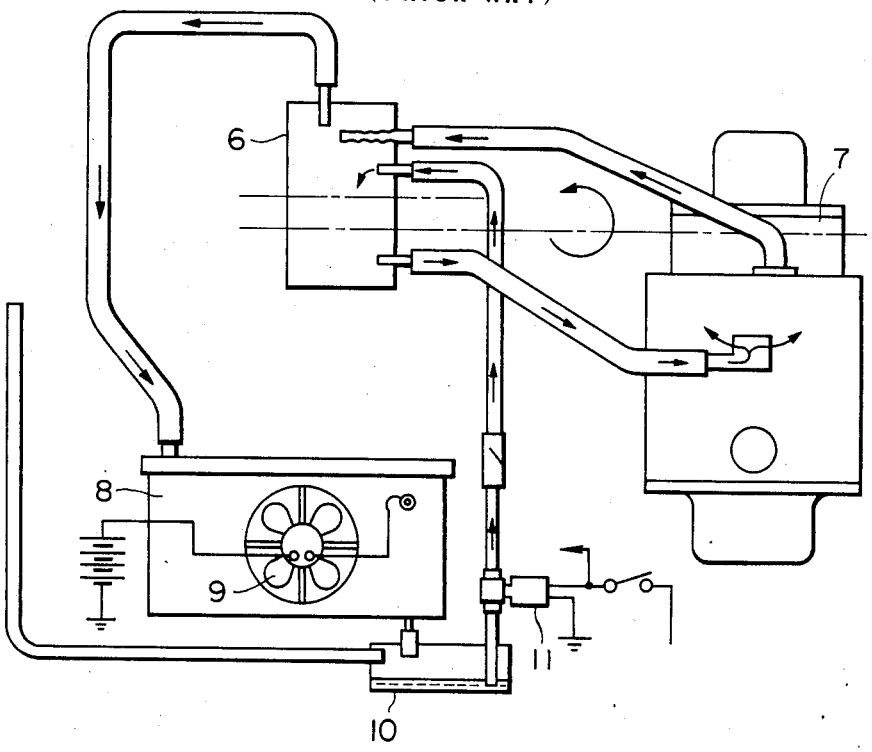
FIG. 3 (PRIOR ART)
FIG. 3 shows in schematic layout form, another of the prior art arrangements previously discussed.
Figure 4:
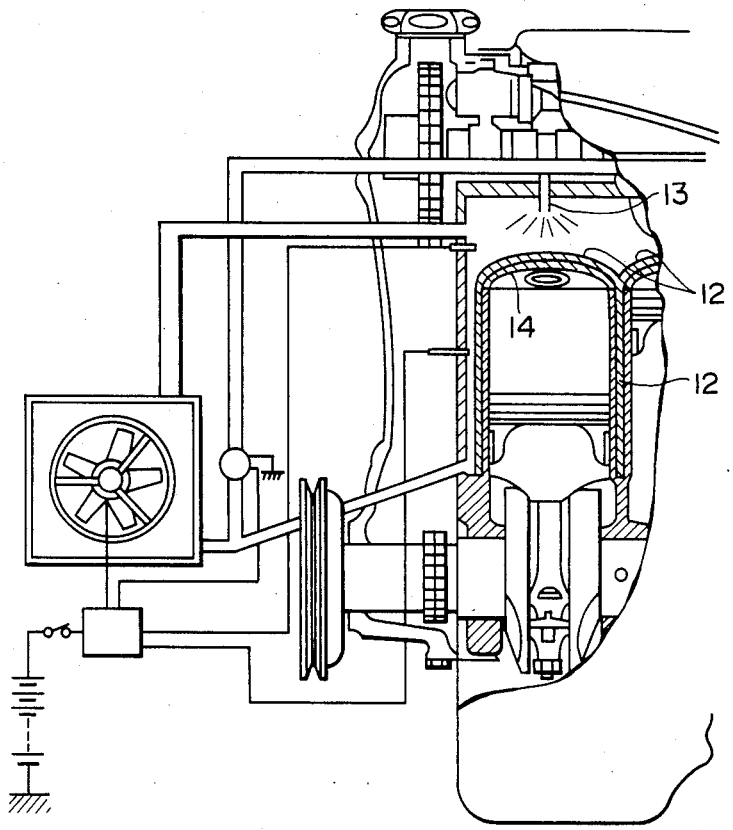
FIG.4 (PRIOR ART)
FIG. 4 shows in partial section yet another of the previously discussed prior art arrangements.
Figure 5:
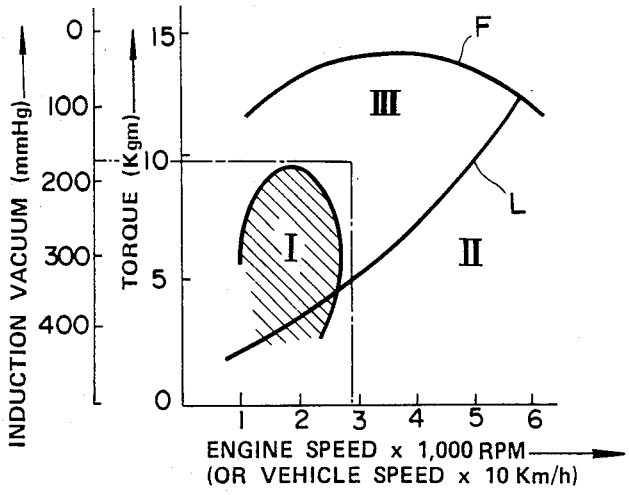
FIG. 5 is a graph showing in terms of induction vacuum (load) and engine speed the various load zones encountered by an automotive internal combustion engine.
Figure 6:
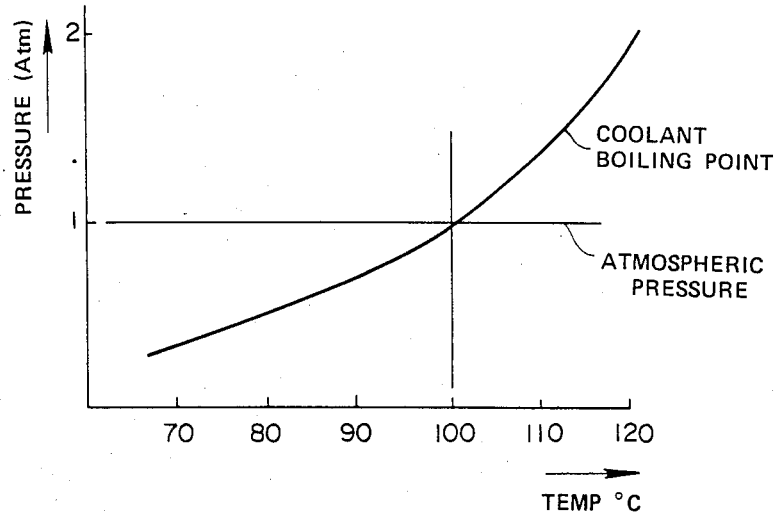
FIG. 6 is a graph showing in terms of pressure and temperature, the change which occurs in the coolant boiling point with change in pressure.

FIG. 5 graphically shows in terms of engine torque and engine speed the various load "zones" which are encountered by an automotive vehicle engine. In this graph, the curve L denotes full throttle torque characteristics, trace L denotes the resistance encountered when a vehicle is running on a level surface, and zones I, II and III denote respectively "urban cruising", "high speed cruising" and "high load operation" (such as hillclimbing, towing etc.).

A suitable coolant temperature for zone I is approximately 110° C. while 90°-80° C. for zones II and III. The high temperature during "urban cruising" promotes improved thermal efficiency while simultaneously removing sufficient heat from the engine and associated structure to prevent engine knocking and/or engine damage in the other zones. For operational modes which fall between the aforementioned first, second and third zones, it is possible to maintain the engine coolant temperature at approximately 100° C.

Figure 7:
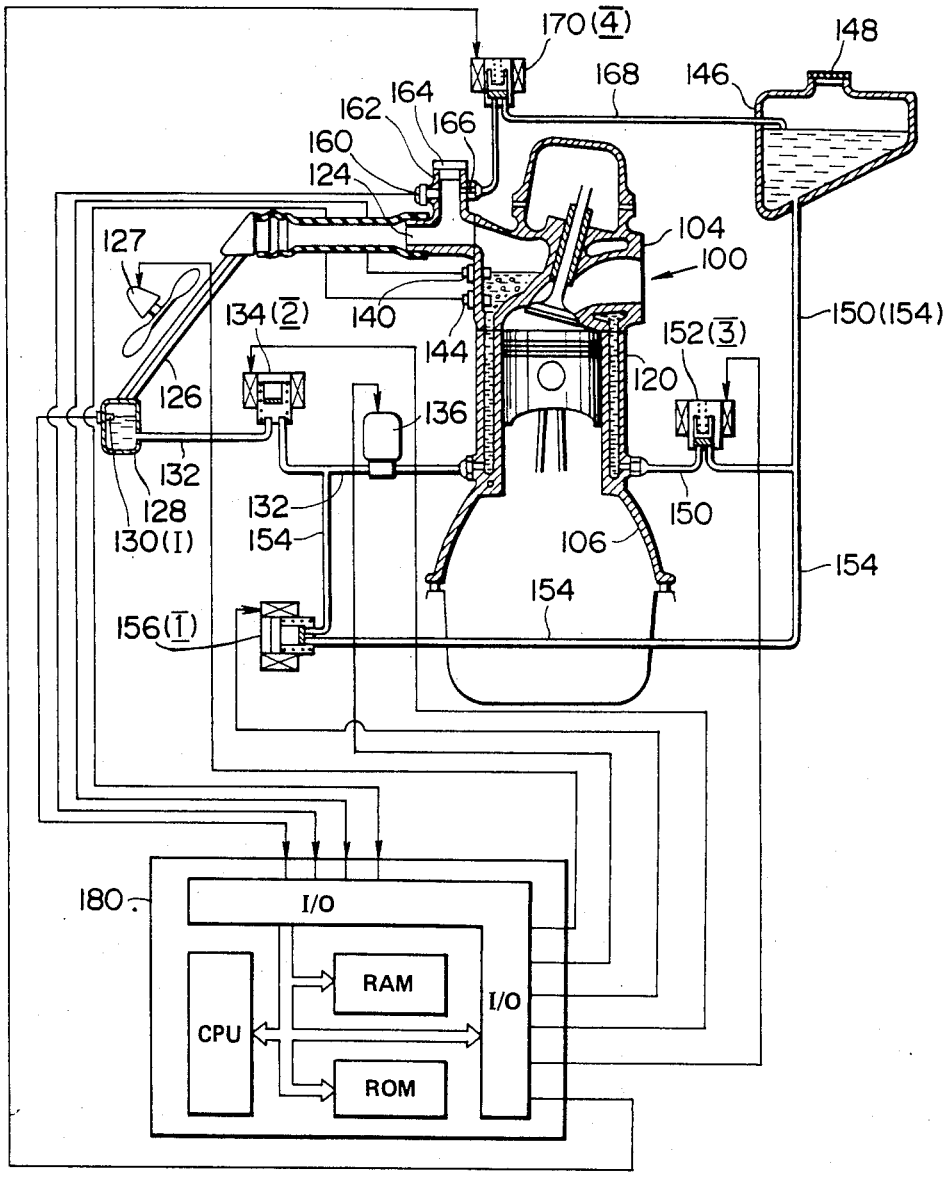
FIG. 7 shows in schematic elevation the "internally known" arrangement disclosed in the opening paragaphs of the instant disclosure in conjunction with copending U.S. Ser. No. 663,911.

With the present invention, in order to control the temperature of the engine, advantage is taken of the fact that with a cooling system wherein the coolant is boiled and the vapor used a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is closed. Thus, by circulating only a limited amount of cooling air over the radiator, it is possible reduce the rate of condensation therein and cause the pressure within the cooling system to rise above atmospheric and thus induce the situation, as shown in FIG. 7, wherein the engine coolant boils at temperatures above 100° C. for example at approximately 119° C. (corresponding to a pressure of approximately 1.9 Atmospheres).

On the other hand, during high speed cruising, it is further possible by increasing the flow cooling air passing over the radiator, to increase the rate of condensation within the radiator to a level which reduces the pressure prevailing in the cooling system below atmospheric and thus induce the situation wherein the coolant boils at temperatures in the order of 80° to 90° C. However, under such conditions the tendency for air to find its way into the interior of the cooling circuit becomes excessively high and it is desirable under these circumstances to limit the degree to which a negative pressure is permitted to develop. This can be achieved by permitting coolant to be introduced into the cooling circuit from the reservoir and thus raise the pressure in the system to a suitable level.

Figure 8:
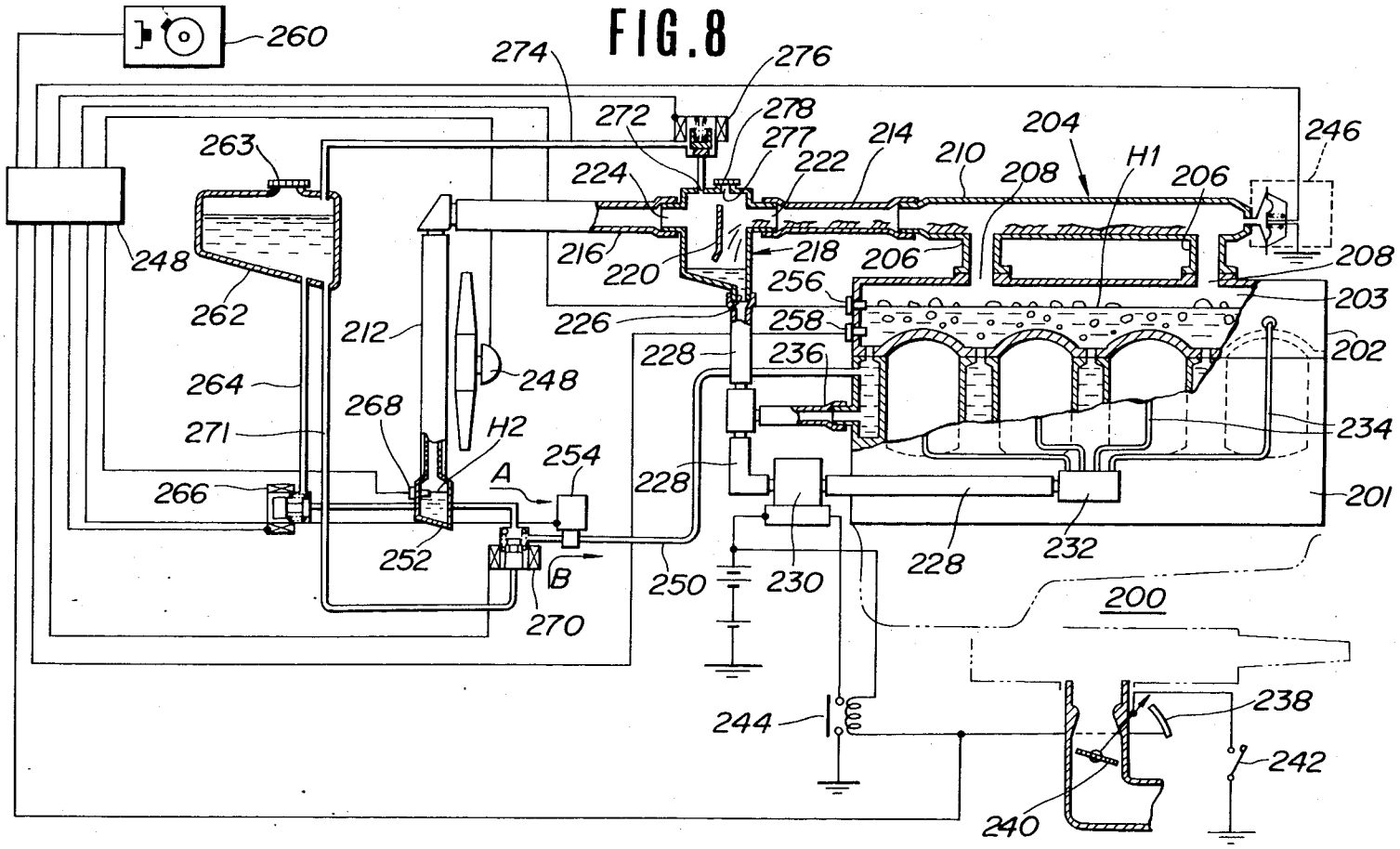
FIGS. 8, 9 and 10 show sectional elevations of first, second and third embodiments of the present invention respectively.

FIG. 8 shows an engine system incorporating a first embodiment of the present invention. In this arrangement, an internal combustion engine 200 includes a cylinder block 201 on which a cylinder head 202 is detachably secured. The cylinder head and cylinder block include suitable cavities which define a coolant jacket 203 about the heated structure of the cylinder head and block.

A vapor manifold 204 is mounted on the cylinder head 202. Branch runners 206 lead from vapor discharge ports 208 formed in the upper section of the cylinder head 202 to the main body or collector section 210 of the vapor manifold.

A condenser or radiator 212 (as it will be referred to hereinafter) is fluidly communicated with the vapor manifold 204 by vapor transfer conduits 214, 216 and a liquid/vapor separator unit 218. This latter mentioned unit as shown, includes a baffle 220 which is located between an inlet orifice 222 and an outlet orifice 224 in a manner that any vapor and/or liquid coolant which enters the separator 218 is forced to undergo sharp changes in flow direction. These changes of course induce a separation of gaseous and liquid coolant, the latter being collected in a trap located below the baffle 220. It will be understood that although only one baffle is shown, a plurality of the same may be arranged in a well known manner to improved the separation efficiency of the device if so desired.

A drain port 226 formed in a lower section of the separator is fluidly communicated with a section of the coolant jacket formed in the cylinder head 202 by way of a conduiting arrangement which includes a main conduit section 228, a pump 230 (this pump will be referred to as the "drain" pump hereinafter), a gallery 232 and a plurality of branch "return" runners 234. A short circulation conduit 236 leads from a lower section of the coolant jacket 203 (a section of the jacket which surrounds engine structure which is subject to a relatively low heat flux and wherein the coolant tends not to boil) and intersects with the main conduit 228 at a location between the drain pump 230 and the drain port 226.

It will be noted that the so called "return" branch runners 234 are arranged to communicate with sections of the coolant jacket formed in the cylinder head 202 in a manner to inject coolant into zones where the highest heat flux tends to occur. The reason for this arrangement will become clear hereinlater.

In the first embodiment the pump 230 is arranged to be electrically driven and arranged to be supplied electrical power upon a switch 238 operatively connected with the throttle valve 240 of the engine 200 being closed by the throttle valve being opened beyond a predetermined amount. As shown, this switch 238 is circuited in series with a switch 242 which is synchronously opened and closed with the ignition switch of the engine. In the illustrated embodiment a relay 244 is arranged to be closed upon closure of both switches and supply current to the motor of the pump 230.

A pressure differential responsive switch arrangement 246 is operatively connected with the vapor manifold 204 and arranged to output a signal indicative of the pressure prevailing in the cooling jacket 203 being below a predetermined minimum allowable level. The output of this device is fed to a control circuit 248 which includes a microprocessor of the nature used in the arrangement shown in FIG. 7 of the drawings.

Located suitably adjacent the radiator 212 is a electrically driven fan 248. Disposed in a coolant return conduit 250 which leads from a small collection reservoir 252 or lower tank as it will be referred to hereinafter, to an upper section of the coolant jacket defined within the cylinder block 201, is a return pump 254.

In order to control the level of coolant in the coolant jacket 203, a level sensor 256 is disposed as shown. It will be noted that this sensor is located at level (H1) which is selected to be higher than that of the combustion chambers, exhaust ports and valves (structure subject to high heat flux) and to maintain same securely immersed in liquid coolant and therefore attenuate engine knocking and the like due to the formation of localized zones of abnormally high temperature or "hot spots".

Located below the level sensor 256 so as to be immersed in the liquid coolant is a temperature sensor 258. The output of the level sensor 256 and the temperature sensor 258 are fed to a control circuit 248.

The control circuit 248 further receives an input from the engine distributor 260 (or like device) indicative of engine speed and an input from a load sensing device which in this embodiment takes the form of the throttle valve position switch 238. It will be noted that as an alternative to throttle position, the output of an air flow meter, an induction vacuum sensor or the pulse width of a fuel injection control signal may be used to indicate load and/or control the operation of drain pump.

A coolant reservoir 262 is located beside the radiator 212 as shown. An small air bleed (not shown) formed in the reservoir cap 263 permits atmospheric pressure to continuously prevail therein.

The reservoir 262 fluidly communicates with the cooling circuit via a fill/displacement conduit 264 and an electromagnetic valve 266. This valve is closed when energized. As shown, conduit 264 is arranged to to communicate with lower tank 252.

A second level sensor 268 is disposed in the lower tank 252 and arranged to sense the level of liquid coolant being at or above a level H2.

Leading from reservoir 262 to a three-way valve 270 disposed in the return conduit 250 at a location between pump 254 and the lower tank 252 is a coolant supply conduit 271. The three-way valve 270 is arranged to normally assume a position wherein communication between the lower tank 252 and the pump 254 is established (viz., flow path A) and assume a position wherein communication between the reservoir 262 and the pump 254 is established (flow path B) when energized.

Leading from a purge port 272 formed in the upper section of the separator unit 218, to the reservoir 262 is an overflow conduit 274. Disposed in this conduit 274 is a normally closed electromagnetic valve 276. This valve is arranged to be open (via energization) only during a non-condensible matter purge routine which will be described hereinlater.

Prior to use the cooling circuit is filled to the brim with coolant (for example water to a mixture of water and antifreeze or the like) via a filling port 277 formed in the separator unit 218 and a cap 278 securely set in place to seal the system. A suitable quantity of additional coolant is also placed in the reservoir 262. At this time the elctromagnetic valve 266 should be temporarily energized or a similar precaution be taken to facilitate the complete filling of the system and the exclusion of any air.

When the engine is started the control circuit 248 samples the output of temperature sensor 258 and if the temperature of the coolant is below a predetermined level (45° C. for example) the engine is deemed to be cold and a purge routine executed in order to ensure that prior to being put into normal operation, the system is completely free from comtaminating air which will drastically reduce the heat exchange efficiency of radiator 212.

In order to execute this routine valve 266 is closed via energization, three-way valve 270 conditioned (via energization) to establish fluid communication between the reservoir 262 and pump 254 via conduit 271 while pump 254 and valve 276 are energized. Under these conditions coolant is inducted from the reservoir 262 and forced into the essentially full cooling circuit (viz., the coolant jacket 203, vapor manifold 204, vapor transfer conduits 214, 216, the separator unit 218 (and associated conduiting) radiator 212 and coolant return conduit 250). According, the excess coolant which is forced into the system overflows out through the overflow conduit 274 back to the reservoir 254. This flushes out any air that might have accumulated in the system and thus places the same in condition ready for the excess coolant in the cooling circuit to be displaced out to the reservoir 260 until the levels in the coolant jacket 203 and lower tank 252 reach levels H1 and H2 respectively.

Following the purge operation valves 266, 270 and 276 are de-energized to cut off communication between the purge port 272 and the reservoir 262, open conduit 264 and condition valve 270 to establish flow path A (viz., communicate pump 254 with lower tank 252).

As the cooling circuit is completely filled with stagnant coolant, the heat produced by the combustion in the combustion chambers of the engine cannot be readily released via the radiator 212 to the ambient atmosphere and the coolant rapidly warms and begins to produce coolant vapor. At this time as valve 266 is left de-energized the pressure of the coolant vapor begins displacing liquid coolant out of the cooling circuit via conduit 264.

During this "coolant displacement mode" it is possible for either of two situations to occur. That is to say, it is possible for the level of coolant in the coolant jacket 203 to be reduced to level H1 before the level in the radiator 212 reaches level H2 or vice versa wherein the radiator 212 is emptied before much of the coolant in the coolant jacket is displaced. In the event that latter occurs (viz., the coolant level in the radiator 212 falls to H2 before that in the coolant jacket 203 reaches H1), valve 266 is temporarily closed and the coolant in the coolant jacket allowed to "distill" across to the radiator 212. Alternatively, if the level H1 is reached first, level sensor 256 induces the energization of pump 254 and coolant is pumped from the power tank 252 to the coolant jacket 203 while simultaneously being displaced out through conduit 264 to reservoir 262.

During this displacement mode, the load and other operational parameters of the engine are sampled and a decision made as to the temperature at which the coolant should be controlled to boil. If the desired temperature is reached before the amount of the coolant in the cooling circuit is reduced to the minimum quantity (viz., when the coolant in the coolant jacket and the radiator are at levels H1 and H2 respectively) it is possible to energize valve 266 so that it assumes a closed state and places the cooling circuit in a hermetically closed condition. If the temperature at which the coolant boils should exceed that determined to be best suited for the instant set of engine operational conditions, the circuit may be subsequently reopened and additional coolant displaced out to reservoir 262 to increase the surface "dry" surface area of the radiator 212 available for the coolant vapor to release its latent heat of evaporation.

In operation the above described arrangement is such that when the levels of coolant in the coolant jacket 203 and the lower tank 253 have reached levels H1 and H2 respectively, once the load on the engine is increased beyond a predetermined level, the boiling action in the coolant jacket in the region of the cylinder heads exhaust ports and like structure, becomes sufficiently vigorous as to produce bumping and frothing to the degree that a relatively large vapor collection space is normally required in the upper section of the coolant jacket.

However, according to the present invention, in order to achieve a compact engine arrangement the section of the coolant jacket formed in the cylinder head 202 is arranged to have a relatively small internal volume and a low profile and thus have a relatively small vapor collection space. While this tends to invite relatively large amounts of boiling coolant to froth up into the vapor reservoir, the provision of the separator unit 218 between the vapor manifold 204 and the radiator 212 renders it possible to separate the liquid coolant from the actual coolant vapor before any liquid coolant can actually reach the radiator in a manner which tends to wet the interior thereof and thus reduce the heat exchange efficiency of the same.

Further, by appropriately setting switch 238 it is possible with the present invention to energize drain pump 230 in a manner which inducts coolant from the lower (trap) section of the separator via the drain port 226 and pumps same back into the section of coolant jacket 203 defined in the cylinder head 202. As will be appreciated, the coolant which is inducted out of the separator unit and pumped into the cylinder head has cooled to a temperature which is lower than that at which the coolant in the upper section of the coolant jacket is boiling. Accordingly, the injection of this slightly cooler coolant into that in zones where boiling tends to be most vigorous, tends to damp the frothing and boiling action which normally occurs and thus smooth the boiling action in a manner which tends to attenuate the bumping and frothing and thus reduce the amount of liquid which enters the vapor manifold 210.

In the event that little or no coolant is contained in the separator unit 218, coolant can/or is alternatively inducted, upon drain pump energization, from the lower section of the coolant jacket 203 via conduit 236. In the event that engine has just undergone a cold start (for example) and the cooling circuit is completely filled with coolant, energization of the drain pump 230 tends to (provided that the throttle valve has been opened sufficiently) gently circulate the coolant within the coolant jacket while under normal fully warmed-up operating conditions, enables the injection of relatively cool coolant into the zones surrounding the cylinder heads, exhaust ports etc., and thus bring about the attenuation of the initial promotion of bumping and frothing which tends to cause liquid coolant to be discharged from the coolant jacket and collected in the separator unit 218. As the injection of coolant into the upper section of the coolant jacket tends to reduce the degree to which bumping and frothing occurs, the separator unit 218 can be relatively small and therefore facilitate a compact engine arrangement.

Figure 9:
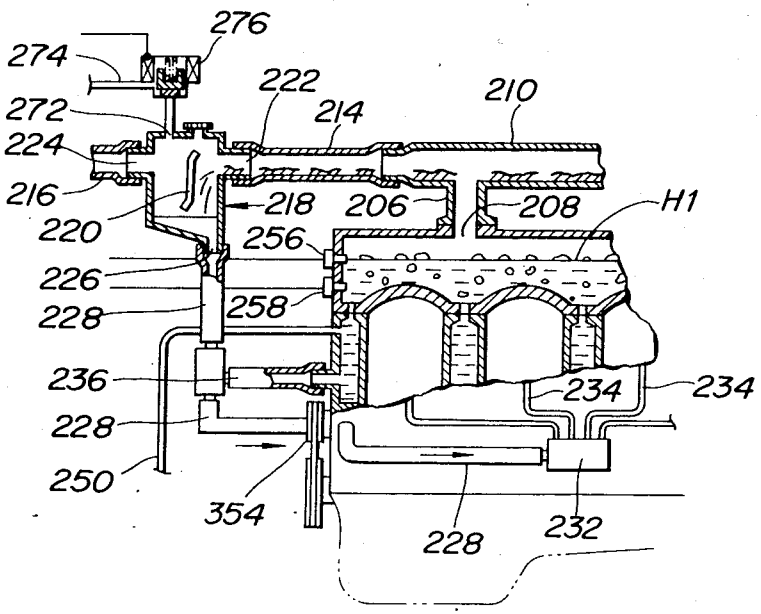

FIG. 9 shows a second embodiment of the present invention. This arrangement differs from the first embodiment in that the electrically controlled and driven pump 230 is replaced with a mechanical driven one (354). It will of course be noted that the capacity of this pump is far smaller than that used in conventional circulation type cooling systems and therefore consumes only a fraction of the engine power.

Due to the provision of conduit 236, circulation of coolant into the zones of maximum heat flux occurs as long as the engine is running and the mechanically driven pump 354 is operative. The provision of conduit 236 also obviates cavitating of the pump in the event that the separator unit 218 does not contain any liquid coolant.

Figure 10:
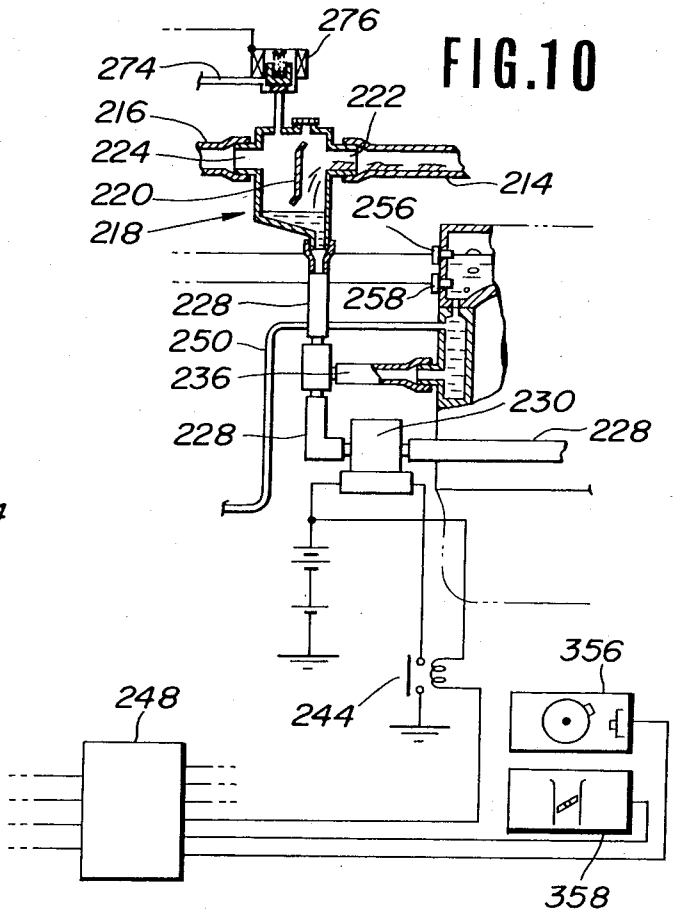

FIG. 10 shows a third embodiment of the present invention. In this arrangement, the drain pump 230 is placed under the control of the microprocessor or like control circuitry contained in the control circuit 248. In this embodiment it is possible to arranged for the pump to be operated in when the operation of the engine falls within zones such as II and III shown in FIG. 5. It is also possible for the pump 230 to be operated intermittently depending on the mode of engine operation as different from the continuous operation which will occur with first embodiment as long as the throttle valve remains open beyond the degree at which switch 238 is closed. In this embodiment the control circuit 248 is arranged to be supplied signals indicative of engine speed and engine load by sensors 356, 358 respectively.

With the embodiments of the present invention, the provision of the pressure differential switch 246 permits the cooling circuits of the respective arrangements to placed in an "open circuit" condition and for coolant to be inducted into the system from reservoir 262 in the event that an excessively low pressure tends to develop and induce the coolant to boil at an undesirably low level and/or induce the situation wherein components of the coolant system are apt to be crushed by the external atmospheric pressure.

When the engine is stopped it is advantageous to maintain valve 266 energized until the temperature of the coolant falls to 80° C. (for example). This obviates the problem wherein large amounts of coolant are violently discharged from the cooling circuit due to the presence of superatmospheric pressure therein.

Although not set forth hereinbefore, it will be understood that once the engine is stopped and has cooled sufficiently, the coolant in the reservoir 254 is allowed to be inducted into the cooling circiut under the influence of the pressure differential which develops between the atmosphere and the interior of the cooling circuit as the coolant vapor condenses to its liquid form, until the cooling circuit is completely filled with liquid coolant.

In the event that when the engine is restarted and the engine coolant is above 45° C. then it can be assumed that there has been insufficient time for contaminating air to enter the system and the purge operation can be omitted.

What is claimed is:

1. In an internal combustion engine a structure subject to high heat flux, and a cooling system for removing heat from said structure, said cooling system comprising:

a cooling circuit including:

a coolant jacket formed about said structure and into which coolant is introduced in liquid form and permitted to boil;

a radiator in which gaseous coolant is condensed to its liquid state;

a vapor manifold communicating with said coolant jacket;

a vapor transfer conduit leading from said vapor manifold to said radiator;

separation means disposed in said vapor transfer conduit for separating liquid and gaseous coolant, said separation means including a drain port;

a first conduit interconnecting said drain port and said coolant jacket;

a drain pump disposed in said first conduit for inducting coolant from said drain port and for pumping same into said coolant jacket;

a second conduit leading from said coolant jacket to said first conduit at a location intermediate of said drain port and said pump; and coolant return means for returning liquid coolant from said radiator to said coolant jacket in a manner to maintain said structure immersed in a predetermined depth of liquid coolant;

2. In an internal combustion engine as claimed in claim 1, further comprising:

a reservoir containing liquid coolant; and valve and conduit means for selectively interconnecting said cooling circuit with said reservoir.

3. An internal combustion engine as claimed in claim 2, wherein said coolant return means includes:

a first level sensor disposed in said coolant jacket at a level which is higher than said structure subject to high heat flux;

a coolant return conduit which leads from the bottom of said radiator to said coolant jacket;

a coolant return pump disposed in said coolant return conduit, said coolant return pump being responsive to said first level sensor to pump coolant from said radiator to said coolant jacket in a manner to maintain the level of coolant in said coolant jacket at that of said first level sensor.

4. An internal combustion engine as claimed in claim 3, wherein said valve and conduit means comprises:

a first valve disposed in said coolant return conduit at a location between said radiator and said coolant return pump;

a coolant supply conduit leading from said reservoir to said first valve, said first valve having a first position wherein communication between said radiator and said pump is established and a second position wherein communication between said reservoir and said coolant return pump is established;

a fill/discharge conduit leading from said reservoir said cooling circuit;

a second valve disposed in said fill/discharge conduit, said second valve having a first position wherein fluid communication between said reservoir and said cooling circuit is established and a second position wherein the communication is cut off;

an overflow conduit leading from a purge port formed in one of said vapor manifold and separation means to said reservoir; and a third valve disposed in said overflow conduit, said third valve having a first nomal position wherein communication between said vapor manifold and said reservoir is interruppted and a second position wherein the communication is permitted.

5. An internal combustion engine as claimed in claim 4, further comprising:

a first parameter sensor disposed in said coolant jacket for sensing a parameter which varies with the temperature of the coolant in said coolant jacket;

a second parameter sensor which senses a second engine operational parameter;

a device disposed with said radiator for varying the heat exchange between said radiator and a cooling medium surrounding said radiator;

a control circuit responsive to the outputs of said first and second parameters sensors for controlling said device in a manner which tends to bring the temperature of the coolant in said coolant jacket to a value most appropriate for the instant load to said engine.

6. In an internal combustion engine as claimed in claim 5, wherein said valve and conduit means further comprises:

a second level sensor disposed in said radiator for sensing the level of liquid coolant therein; and wherein said control circuit is responsive to the outputs of said first and second level sensors and said first and second parameter sensors for selectively opening and closing said first, second and third valves in a manner to:

(a) when the engine is stopped and the coolant in said coolant jacket below a predetermined limit, establishing fluid communication between said reservoir and said cooling circuit in a manner which allows said cooling circuit to be filled with coolant from said reservoir, (b) when the engine is started and below a second predetermined temperature, conditioning said first, second and third valves and energizing said coolant return pump in a manner which forces excess coolant into said cooling circuit in a manner which flushes any non-condensible matter that may have infiltrated the cooling circuit out through said overflow conduit, and (c) when the engine is started and above said second predetermined temperature for permitting coolant to be displaced out of said cooling circuit to said reservoir until one of a desired amount of coolant is retained in the cooling circuit and the coolant temperature reaches a desired value determined in accordance with the inputs from said first and second parameter sensors.

7. An internal combustion engine as claimed in claim 1, wherein said separation means takes the form of:

a container having an inlet and an outlet;

a baffle located between said inlet and outlet ports and arranged so that any fluid entering said container though said inlet port must undergo at least one sharp change in flow direction before reaching said outlet port, said drain port being arranged at a level lower than said inlet and outlet ports.

8. An internal combustion engine as claimed in claim 1, wherein said first conduit connects with said coolant jacket a location proximate structure of the engine subject to high heat flux and whereat vigorous boiling of the coolant tends to occur.

9. An internal combustion engine as claimed in claim 1, wherein said drain pump is driven in synchronism with the crankshaft of said engine.

10. An internal combustion engine as claimed in claim 1, wherein said drain pump is electrically driven and which further comprises:

means for producing a signal indicative the load on said engine being above a predetermined level;

said drain pump being responsive to said signal in a manner to force coolant to flow through said first conduit toward said coolant jacket.

11. An internal combustion engine as claimed in claim 10, wherein said signal producing means takes the form of a switch which is closed when a throttle valve of said engine is opened beyond a predetermined amount.

12. An internal combustion engine as claimed in claim 10, further comprising:

means for sensing a first engine operational parameter and outputting a signal indicative thereof;

circuit means responsive to said first operational parameter sensing means for determining the operation mode of said engine, and wherein said signal producing means takes the form of a circuit responsive to said circuit means and which produces a signal which energizes said drain pump in response to said circuit means determining that said engine is operating in a predetermined mode.

* * * * *